US005556319A

United States Patent [19]

Watkins

[11] Patent Number: 5,556,319

[45] Date of Patent: Sep. 17, 1996

[54] CONFETTI LAUNCHING DEVICE

[76] Inventor: James O. Watkins, 14920 Mt. Nebo Rd., Poolesville, Md. 20837

[21] Appl. No.: 368,500

[22] Filed: Jan. 4, 1995

Related U.S. Application Data

[63] Continuation-in-part of Ser. No. 80,534, Jun. 24, 1993, Pat. No. 5,403,225, which is a continuation-in-part of Ser. No. 51,355, Apr. 23, 1993, Pat. No. 5,352,148.

[51] Int. Cl.[6] ..... A63H 37/00

[52] U.S. Cl. ..... 446/475; 446/429; 124/5

[58] Field of Search ..... 446/475, 429; 124/4, 5; 273/73 L

[56] References Cited

U.S. PATENT DOCUMENTS

| | | | |
|---|---|---|---|
| 249,347 | 11/1881 | Hauver | 446/76 |
| 990,228 | 4/1911 | Cohrs | 446/475 |
| 1,153,207 | 9/1915 | Eisenberg | 446/475 |
| 1,374,420 | 4/1921 | Berggreen | 124/5 |
| 1,491,809 | 4/1924 | Macchia | 446/475 |
| 2,756,737 | 7/1956 | Resch, Jr. | 446/475 |
| 2,997,039 | 8/1961 | Fehn | 124/5 |
| 3,115,129 | 12/1963 | Merriman | 124/5 |
| 3,472,217 | 10/1969 | Erickson | 124/5 |
| 5,000,153 | 3/1991 | Zimmerman et al. | 124/5 |
| 5,108,114 | 4/1992 | Marx | 273/73 G |
| 5,149,290 | 9/1992 | Reveen | 446/475 |
| 5,352,148 | 10/1994 | Watkins | 446/475 |
| 5,354,227 | 10/1994 | Watkins | 446/475 |
| 5,403,225 | 4/1995 | Watkins | 446/475 |

FOREIGN PATENT DOCUMENTS

| | | | |
|---|---|---|---|
| 361617 | 9/1906 | France | 446/475 |
| 301655 | 9/1920 | Germany | 124/5 |
| 10850 | of 1903 | United Kingdom | 446/475 |
| 341784 | 1/1931 | United Kingdom | 446/475 |
| 2228870 | 9/1990 | United Kingdom | 601/101 |

*Primary Examiner*—Robert A. Hafer
*Assistant Examiner*—Jeffrey D. Carlson
*Attorney, Agent, or Firm*—Ronald B. Sherer

[57] ABSTRACT

A confetti launching wand is disclosed in which the wand comprises a relatively short barrel portion which contains the confetti, preferably in the form of a stack or bundle, and the barrel portion is connected to a relatively long handle portion. In some embodiments the barrel portions may be separable from the handle portion and may be replaced by other barrel portions designed to launch multiple bundles of confetti in different, non-parallel trajectories, and/or the handle and barrel portions may be composed of biodegradable materials such as paper and cardboard. Tapered barrels are also disclosed which may be composed of deformable materials such as thin plastic, rubber or plastic foam, or rolled cardboard or paper.

3 Claims, 5 Drawing Sheets

CONFETTI LAUNCHING DEVICE

This application is a continuation-in-part of application Ser. No. 08/080,534 filed Jun. 24, 1993, now U.S. Pat. No. 5,403,225, which, in turn, was a continuation-in-part of Ser. No. 08/051,355 filed Apr. 23, 1993, now U.S. Pat. No. 5,352,148; the complete disclosures of said application and patent being hereby incorporated by reference.

FIELD OF THE INVENTION

This invention relates to a device for launching confetti, and more particularly, to a reusable wand having a handle and one or more barrels from which barrels confetti is launched into the air by centrifugal force when the wand is waved forwardly in an arcuate motion with the arm and with a flick of the wrist.

BACKGROUND

Application Ser. No. 08/080,534, now U.S. Pat. No. 5,403,225 discloses an apparatus and method for launching confetti into the air by the simple act of waving a one-piece, hollow tube filled with confetti in a arcuate motion such that the confetti flies out of the tube under centrifugal force. The confetti is preferably in the form of unwrapped piles or stacks of confetti pieces, or wrapped stacks of confetti hereinafter referred to as bundles. The confetti is preferably of four-sided shape such as the elongated tetragonal, and preferably rectangular, confetti as more fully disclosed in the above-identified parent application and patent. The elongated hollow tubes are of constant cross-section and are preferably filled with multiple stacks or bundles of confetti aligned in series along the length of the tube with each stack or bundle being in slight frictional contact with the interior wall of the elongated tube. For example, the shorter tubes, such as those in the order of 6 inches in length, generally contain in the order of 3 to 4 stacks or bundles per tube, while longer tubes, such as those in the order of 12 to 18 inches in length, generally contain in the order of 6 to 12 stacks or bundles per tube.

In use, such confetti-filled tubes are waved with the forearm and with a flick of the wrist one or more times until all of the stacks or bundles of confetti have been ejected from the tube high into the air. Once used, the empty plastic tubes have no further utility and thus become immediately disposable. Such tubes as described in the above-identified Application, sold under the trademarks FLUTTER-FLICKER for the shorter tubes and FLUTTER-FLINGER for the longer tubes, have been very commercially successful such that hundreds or even thousands of empty tubes may remain on the premises after use and disposal on the ground by fans at a sporting event, or by attendees at an amusement park or other event such as a parade. Such tubes have been composed of thin-walled, relatively rigid plastic, such as propionate or styrene, for example. While such plastic is ideal from a cost and manufacturing standpoint, the job of picking-up hundreds or a thousand empty plastic tubes presents an additional burden on the grounds keepers and maintenance personnel. In addition, the plastic tubes may present a disposal problem because the plastic tubes are not biodegradable such that they may be required to be separated from the used confetti which is highly biodegradable and may be required to be disposed of separately from non-biodegradable waste. Also, the frictional contact of all of the bundles with the interior surface of the tube tends to retard ejection of the later-ejected bundles which are located further from the open end of the tube.

SUMMARY OF THE INVENTION

The present invention eliminates the above-indicated disadvantages, while maintaining all of the advantages of launching confetti by a simple hand-operated device, by creating a wand with handle and barrel portions both of which portions are reusable, and therefore, the wand is not discarded by a user after only one use. In addition, in one preferred aspect of the invention, the barrel portion may be formed of deformable material, and one or both of the handle and barrel portions may be composed of cardboard or rolled paper such that one or both portions of the wand are highly biodegradable when they are eventually disposed after many uses. In addition, the relatively long handle portion permits the use of a relatively short barrel for improved ejection of the stacks or bundles. These and other objects and advantages of the invention will become more fully apparent from the following description of several illustrative embodiments of the invention illustrating several preferred features and combinations of features of the invention as further shown, by way of example, in the accompanying drawings.

DETAILED DESCRIPTION

Figure 1:
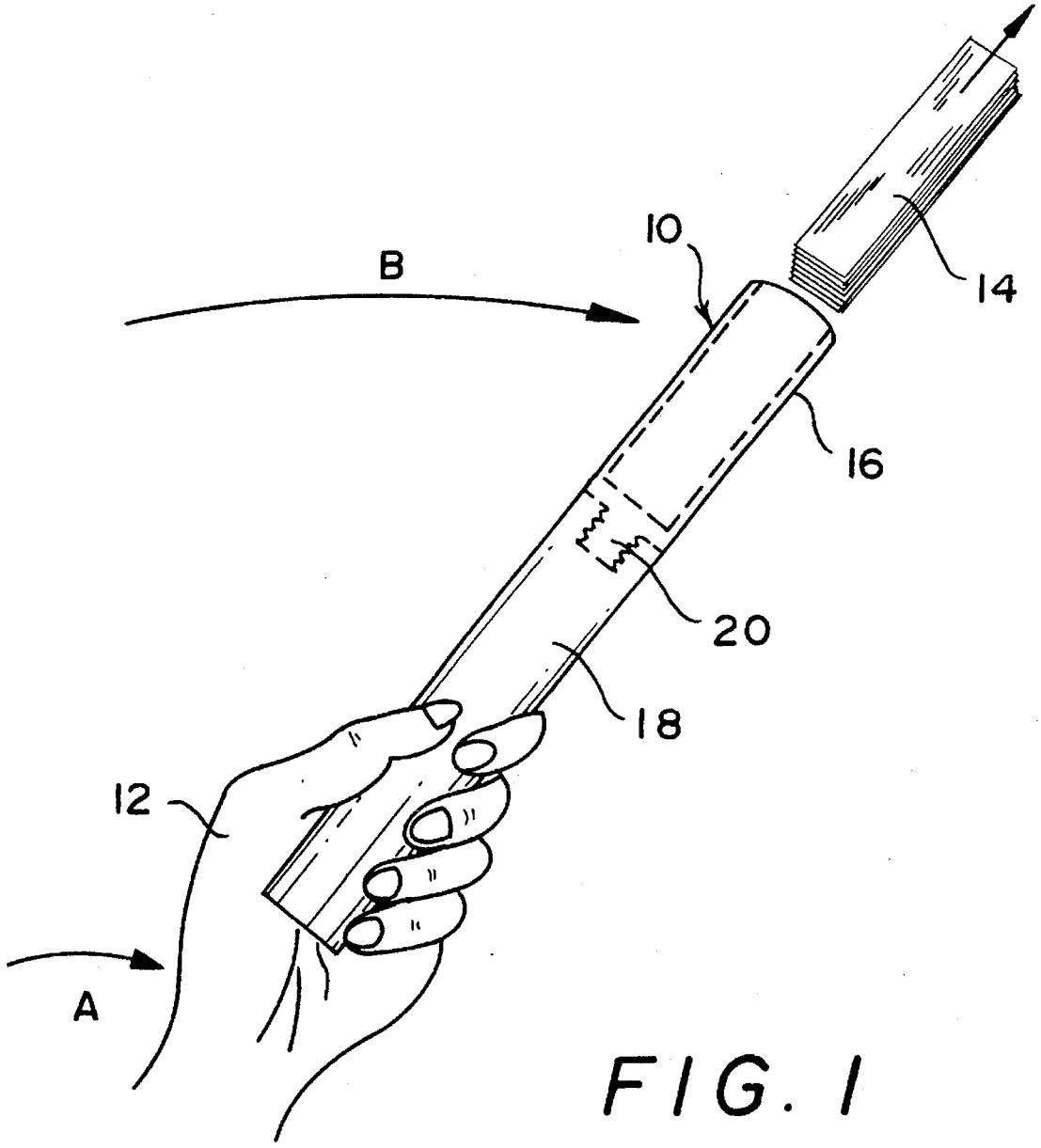
FIG. 1 is a schematic illustration of one form of the wand of the present invention in the hand of a user propelling a stack of confetti into the air.

Referring to FIG. 1, wand 10 is shown in the hand 12 of a user as the user moves the forearm forwardly in the direction of arrow A, and with a flick of the wrist, such that the wand is moved rapidly in an arcuate path illustrated by arrow B. Such movement creates sufficient centrifugal force to eject confetti 14 from barrel 16 such that the confetti, preferably in the form of an unwrapped stack or wrapped bundle, is projected 10 to 20 or more feet into the air, at which point, the bundle or stack bursts into hundreds of individual pieces of confetti which flutter and float slowly to the ground in a dramatic visual display of color and motion simulating actual fireworks. Further details of preferred methods of forming stacks and wrapped bundles of confetti, and preferably end-wrapped bundles, are disclosed in the aforementioned application and patent, as well as in application Ser. No. 08/108,245, now U.S. Pat. No. 5,419,731, which is also incorporated herein by reference.

Figure 2:
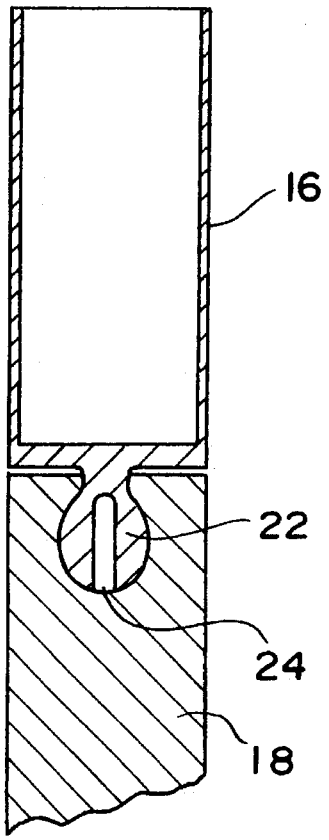
FIG. 2 is a cross-sectional, partial view of one embodiment of the wand showing one form of removable attachment of the barrel to the handle.

As further shown in FIG. 1, hollow barrel 16 may be connected to a separate handle 18 by a removable connector 20. For example, connector 20 may be a threaded shaft integral with the base of barrel 16 which may be removably screwed into a threaded bore in the upper portion of the handle. Alternatively, the upper portion of handle 18 may be threaded and be received in a threaded bore in barrel 16. Alternatively, as shown in FIG. 2, the base of barrel 16 may be provided with an enlarged projection, such as a plurality of flexible prongs or detents 22, which are received in and snap into a mating bore with an enlarged portion 24 into which the prongs of the detent expand and frictionally lock the barrel to the handle unless forcefully pulled apart by the user. Of course, many other types of removable connectors may be used to removably connect barrel portion 16 to handle portion 18 including, for example, other forms of snap-action connectors, removable pins, bayonet or dovetail joints, and other connectors known per se in the connector art; some of such connectors being further described hereinafter by way of illustrative examples.

Instead of providing a relatively long tube of six or more inches of length containing three to twelve or more bundles of confetti as previously described with respect to the FLUTTER FLICKER and FLUTTER FLINGER tubes, one important aspect of the present invention relates to the provision of a substantially shorter barrel, such as in the order of only one to three inches with a handle portion several times the length of the barrel such as 6 to 12 inches. The short barrel is simple and easy for the user to refill many times with one to three stacks or bundles, for example, and preferably only one or two stacks or bundles per loading. More specifically, the present invention contemplates that, instead of purchasing a relatively long, pre-loaded tube which becomes disposable after only one use, the user may purchase a kit containing one handle, several barrels of different configuration as will be further described, and a plurality of stacks or bundles of confetti such as, for example, one or more dozen stacks or bundles in a pack. In this manner, the user may launch some or all of the stacks or bundles at a given event, but the user retains the barrel and handle for future use with the remaining stacks or bundles, or with additional stacks or bundles which may be purchased at a later date. As a result, the handle and barrel(s) are not discarded after the first use, and therefore, do not become an immediate disposal problem.

It has also been discovered that, instead of providing a plurality of bundles in a relatively long, straight tube of constant diameter, with each bundle in light frictional contact with the interior of the tube, substantially improved performance may be obtained by sizing the interior dimensions of a short barrel relative to the size of the bundle of confetti such that only the lower portion of the bundle is in frictional contact with the barrel. That is, such that only the lower edges and/or corners of the bundle are in significant frictional contact with two or more inner side or corner surfaces of the barrel. In this manner, as the user waves the wand, the bundle is held in position by frictional contact until the centrifugal force builds up to a maximum near the end of the arcuate motion, at which point, the large centrifugal force overcomes the frictional resistance holding the wedged bundle such that the bundle exits the barrel. In this manner, the bundle exits with much greater force than if a plurality of bundles are loosely contained in an elongated tube, or even in light frictional contact with the elongated tube, such that the bundle adjacent the open end of the tube begins to exit the tube as soon as the minimum amount of centrifugal force is developed, and the lower bundles in the tube must slide up the tube in frictional contact therewith before they are ejected.

Figure 3:
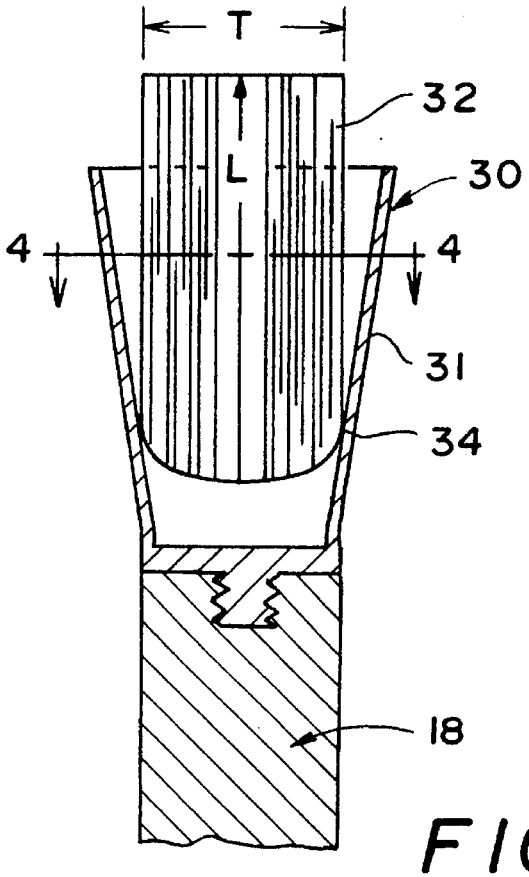
FIG. 3 is a cross-sectional, partial view of a tapered form of barrel of the present invention.
Figure 4:
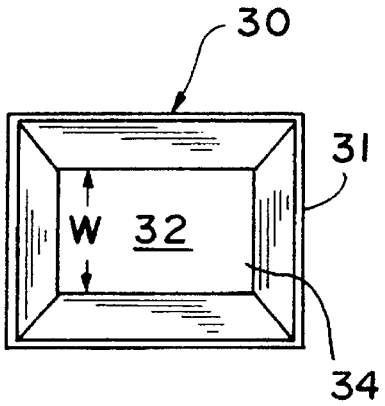
FIG. 4 is a sectional view of the barrel taken along view line 4—4 of FIG. 3.

FIG. 3 illustrates one embodiment of a barrel and a wedged bundle wherein the lower portion of bundle 32, which is illustrated as having a rectangular cross-section along the horizontal plane; ie, parallel to view line 4—4, is wedged in barrel 30 which is illustrated as having tapered sides 31 forming a rectangular cross-section. In this embodiment, tapered barrel 30 is preferably composed of essentially rigid and non-deformable material such as, for example, metal, wood or plastic having a wall thickness such as to remain of the same, rectangular cross-section before, during and after the bundle is wedged therein. However, it is to be understood that other materials may be employed, as will be more fully described hereinafter, and it is to be understood that it is not necessary that the cross-sectional shape of the barrel be the same as that of the bundle. For example, a bundle of rectangular cross-section may be wedged into a tapered barrel of square or round cross-section, or a bundle of square cross-section may be wedged into a tapered barrel of round or rectangular cross-section so long as portions of at least two tapered walls of the barrel are sized so as to be slightly smaller than the diameter of two lower side edges 34 of the bundle. Also, it is to be noted that, while barrel 30 may be longer than the length of the bundle, one preferred feature of the invention is to have the barrel shorter than the bundle length whereby the upper sides of the bundle cannot contact the barrel and cause frictional drag on the bundle as it exits the barrel.

Figure 5:
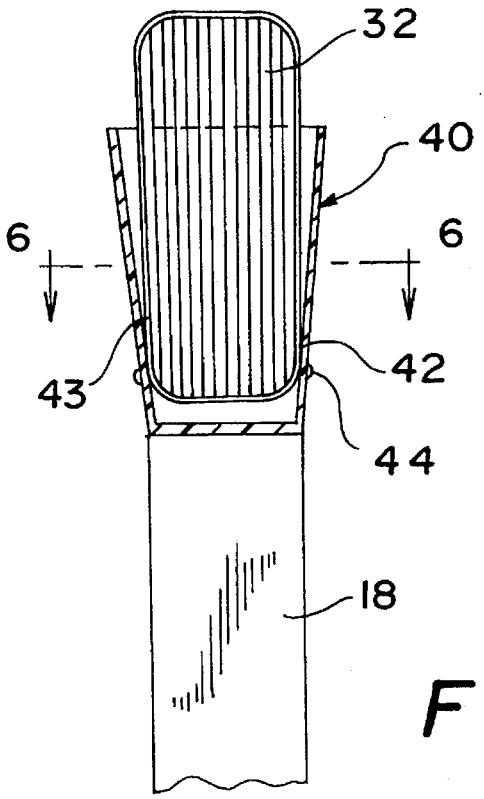
FIG. 5 is a side elevational view, partly in cross-section, showing a further form of barrel composed of deformable material.
Figure 6:
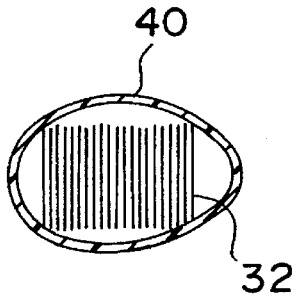
FIG. 6 is a sectional view of the barrel of FIG. 5 taken along view line 6—6.

In a further preferred aspect of the invention illustrated in FIGS. 5 and 6, tapered barrel 40 is composed of flexible, deformable material such as plastic or rubber foam or polyethylene, for example, or other deformable materials to be described hereinafter, such that the cross-sectional shape of the barrel changes; ie, deforms, when the bundle of confetti 32 is wedged therein. For example, barrel 40 may have a circular cross-section when a bundle is not wedged therein, but as shown in FIG. 6, the circular cross-section becomes elliptical when bundle 32 of rectangular cross-section is forced downwardly into the tapered barrel and wedged therein, or a barrel of circular cross-section becomes partially square when a square bundle is inserted therein. In this embodiment, the amount of frictional force holding the lower edges 42 and lower corners 43 of bundle 32 becomes a function of the deformability of the barrel. Since deformability can be controlled in the manufacture by the selection of the wall thickness and type of plastic, foam or other deformable material, the amount of frictional force holding the lower portion of the bundle can be predetermined in the manufacture of the barrel. Of course, the amount of frictional force is also a function of how far the lower portion of the bundle is pushed into the tapered, deformable barrel. Therefore, the preferred embodiment includes a marker line 44, which may be molded into the barrel, or otherwise applied to the barrel, such that the user has a guide as to how far the bundle should be pushed into the barrel for a given amount of frictional holding force. Also, the user may increase or decrease the amount of this force as desired by pushing the bundle a greater or lesser amount into the barrel. As a result, the user may launch a given bundle of confetti to greater heights than previously obtained with straight tubes, and by adjusting the degree to which the bundle is wedged into the barrel, the user may obtain different heights and may compensate for whether the wand is to be used by a child, an elderly person, or an adult with a strong arm. For general use, however, it is preferred that the bundle be inserted such that 50% or less of the length of the bundle be in frictional contact with the barrel. As in the prior embodiments, the barrel is reusable, and replaceable with other barrels, so that the user may simply refill the barrel with one or two bundles of confetti as desired; one bundle being preferred for maximum height of launch with minimum effort.

Figure 7:
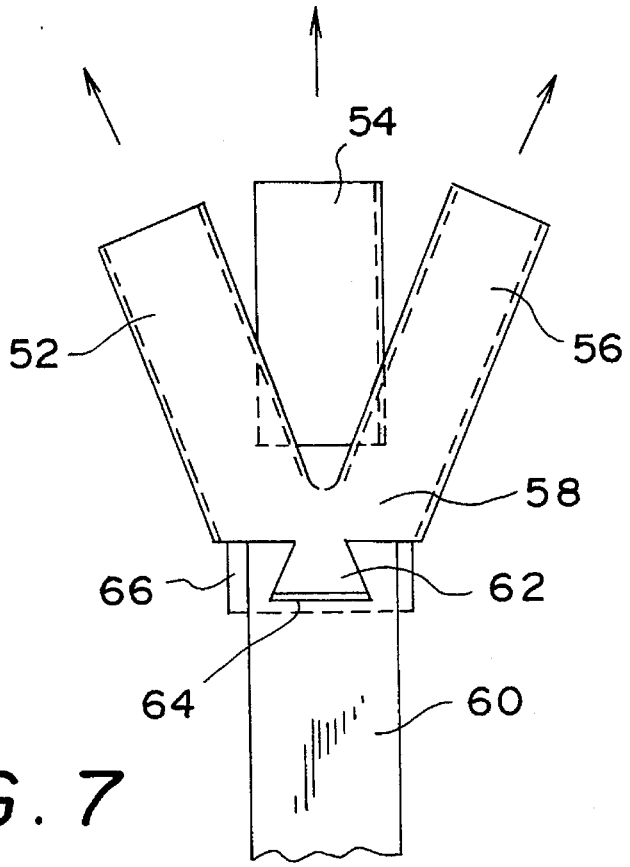
FIG. 7 is a side elevational view, partly in cross-section, showing one multiple barrel configuration.

In the foregoing embodiments, the wand has been illustrated as comprising one barrel for each handle such that, if two or three bundles of confetti are used in the barrel, the bundles are positioned in series along the longitudinal length of the barrel, as is also the series arrangement disclosed in the aforementioned parent Application. Such positioning of the bundles aligned in series along the length of the prior tubes causes the bundles to exit the tubes in a relatively straight line like a stream of bundles such that the bursting of each bundle occurs at substantially the same position in the air, or slightly lower for later-ejected bundles because the sliding frictional contact of the bundles with the interior of the straight-walled barrel, however slight, impedes the exit velocity of the later-ejected bundles. In the present invention, an even greater visual effect of multiple bundles bursting at maximum height in the air may be achieved by a multiple-barrel configuration such as illustrated in FIG. 7 wherein multiple barrels 52, 54 and 56 are provided with a single base 58. The base and multiple barrels may be molded as a one-piece unit, or separate barrels may be permanently secured to the base as by gluing. Alternatively, separate barrels may be removable secured to the base by any of the removable connectors previously described or by other connectors well-known per se. In the latter embodiment, base 58 may be made integral with the handle 60, or if the barrels 52, 54 and 56 are integral with or permanently connected to base 58, then the base may be removably connected to the handle. This may be accomplished as previously described, or by other connectors well-known per se. For example, one preferred connector comprises an enlarged projection 62 which may be of a dovetail or inverted T-shaped configuration. Projection 62 may be received in a correspondingly shaped slot 64 in the upper end of handle 60 as by sliding base 58 and dovetail 62 laterally into slot 64; ie, sliding the dovetail perpendicular to the plane of the drawing. The dovetail, or other enlarged projection, may be retained laterally by an axially slidable, or rotatable, ring or band 66 which prevents the dovetail from sliding laterally out of slot 64. This type of positively locking connector is preferred for the greater mass of the multi-barrel head so that the head is positively locked against separation from the handle. By a "positively locking" connector is meant a connector in which the barrel(s) cannot be separated from the handle by a force acting along the longitudinal direction of the handle such as in the case of connector 22 for example. Rather, threaded connectors, enlarged projections such as dovetail 62, or bayonet joints as described hereinafter, are preferred not withstanding that the barrel portions are of light, non-injurious materials.

Each of barrels 52, 54 and 56 may be short, straight-sided barrels as in the embodiments of FIGS. 1 and 2, or they may be rigid or deformable tapered barrels as in the FIG. 3–6 embodiments. It will also be understood that, while barrels 52, 54 and 56 may extend with their longitudinal axes parallel to each other as will be further described with reference to FIG. 8, the FIG. 7 embodiment illustrates the barrels as extending at acute angles relative to each other. Thus, when one or two bundles of confetti are ejected substantially simultaneously from each of the barrels, the bundle or bundles from each barrel diverge from each other as they rise in the air, and they burst at positions which are at substantially the same height, but are laterally spaced from each other. As a result, with only one bundle of confetti in each of the three barrels, three laterally-spaced bursts may be obtained such as to produce a display pattern which may be over 30 feet in width and may comprise a thousand or more individual pieces of confetti with only one wave of the wand. Thus, with multiple barrels, the size of each barrel is preferably sized so as to accept only one bundle or stack per barrel.

Figure 8:
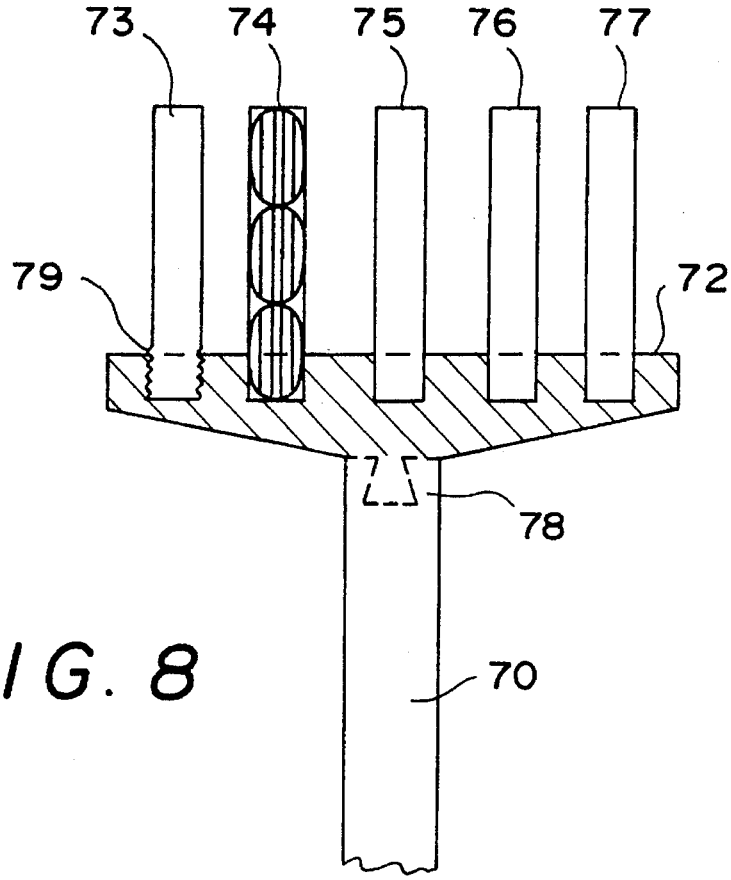
FIG. 8 is a side elevational view, partly in cross-section, showing an alternate configuration of handle and multiple barrels.

Although the above-described embodiments have focused on the advantages of tentatively short barrels, such as sufficient to contain only one or two stacks or bundles, and preferably only one stack or bundle, the principals of the present invention are also usable with longer barrels such as, for example, where even more massive displays of confetti are desired and the user is willing to re-load a larger number of stacks or bundles of confetti into the reusable barrels. One such embodiment is illustrated in FIG. 8. The wand of this embodiment may comprise an elongated handle portion 70, a base portion 72, and a plurality of barrels 73–77 extending parallel or at small angles to each other. As illustrated, handle 70 is removably connected to head portion 72 by a positively locking connector such as, for example, a threaded or dovetail connector 78, and barrels 73–77 may be permanently connected to base 74. Alternatively, handle 70 and base 72 may be permanently connected, or be an integral, one-piece unit, with the barrels removably connected to base 74. For example, as shown on the left side of FIG. 8, barrel 74 may have a threaded external portion or enlarged ring 79 which is received in a threaded bore in base 72, or other forms of well-known removable connectors may be employed. Any number of barrels may be employed such as, for example, two to six or more depending on the massiveness of the display desired, and each of the barrels may be sufficiently long to contain one to four or more bundles. Thus, the present invention encompasses short barrels in the order of one to three inches for the advantages described above, as well as somewhat longer barrels such as up to four or five inches for special effects and particularly massive displays.

Figure 9:
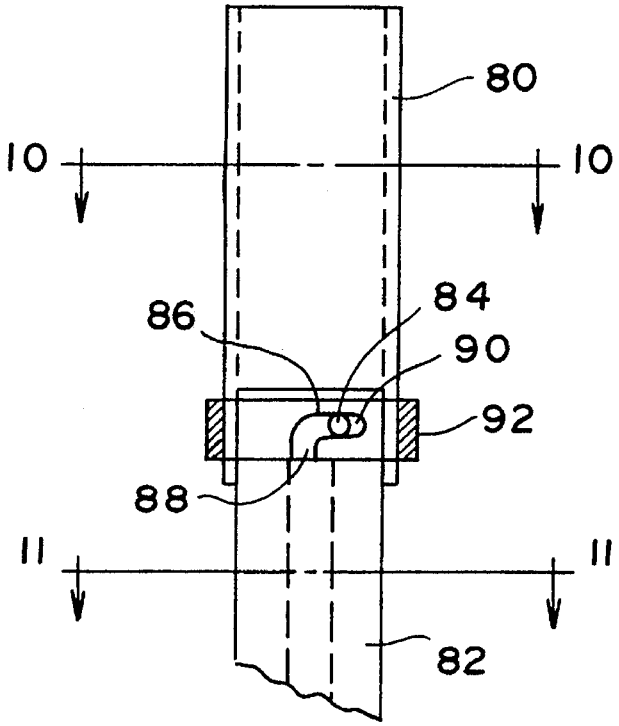
FIG. 9 is a side elevational view, partly in cross-section, illustrating one alternate form of a wand composed of cardboard and rolled paper.
Figure 10:
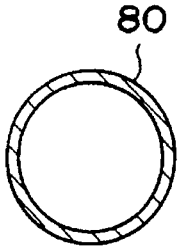
FIG. 10 is a sectional view taken along view line 10—10 of FIG. 9.
Figure 11:
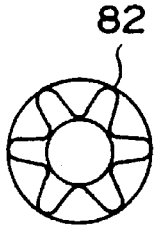
FIG. 11 is a sectional view taken along view line 11—11 of FIG. 9.

In the description of the foregoing illustrative features of the present invention, it has been mentioned that the barrels and handles may be manufactured from plastic or other materials. For example, for more rigid and durable wands, such as for professional use, the wands may be made from stronger materials such as wood or metal tubing; ie, such as extruded aluminum tubing, for example. On the other hand, for amateur use, and particularly where the above-mentioned disposal problem is critical, it has been discovered that the handles and barrels may be made from highly biodegradable materials such as lightweight cardboard, corrugated cardboard and/or rolled paper. One embodiment of a wand composed of such materials is illustrated in FIGS. 9–11 wherein barrel 80 is composed of rolled paper. For example, it has been found that a few wrappings, such as two to ten wrappings, for example, of pad paper, newspaper, kraft paper, or even tissue paper may be rolled to form a barrel which is sufficiently strong to hold and eject one or two stacks or bundles of confetti. Thus, a barrel composed of a few wrapped layers of paper is extremely low-cost to manufacture, lightweight to ship and use, and is highly biodegradable whether it is used many times or disposed of after only one use.

Referring to FIGS. 9–11, handle 82 may be composed of rolled cardboard, either spirally-wrapped, solid-walled cardboard, or one or more layers of corrugated cardboard as illustrated in the cross-sectional view of FIG. 11. Thus, the handle is also very low-cost, lightweight and fully biodegradable. The handle and barrel may be of one-piece such as paper or cardboard as just described, or barrel 80 may be removably secured to handle 82 with any number of connectors as previously described, or otherwise known per se in the removable connector art. However, one preferred form of simple, low-cost connector is illustrated as being of the bayonet type. In this embodiment, a horizontally extending pin 84 may be force-fitted and/or glued in the top of handle 82 so that short portions, or so-called "ears" of the bayonet joint, extend laterally outwardly from the handle; ie, they extend outwardly and perpendicularly to the vertical, longitudinal axis of the handle. The lower portion of the barrel is provided with a pair of L-shaped slots 86 having vertical portions 88 and horizontal portions 90. The ears of the pins enter vertical slot portions 88 when barrel 80 is aligned co-axially with handle 82, and the ears become locked when the barrel is rotated such that the ears slide into horizontal slot portions 90. If desired, a reinforcing band 92 of cardboard or plastic may be glued or otherwise secured to the lower end of the barrel so as to provide additional strength in the area of bayonet slot 86. Similarly, instead of pin 84 extending through handle 82, a band or ring (not shown) having laterally extending projections corresponding to the ears may be glued or otherwise secured to the outer surface of the top portion of handle 82. While FIGS. 9–11 illustrate a single barrel, it is to be understood that multiple barrels may also be provided in the same manner such as, for example, gluing or otherwise securing other barrels to barrel 80, or to a common base as previously described with reference to FIGS. 7 and 8.

Figure 12:
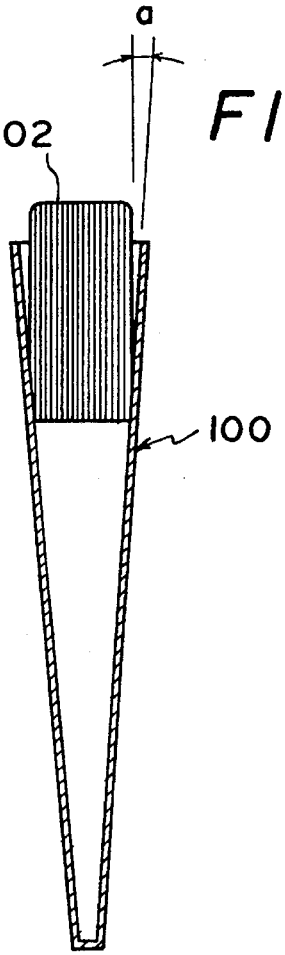
FIG. 12 is a side elevational view of a one-piece, tapered wand.
Figure 13:
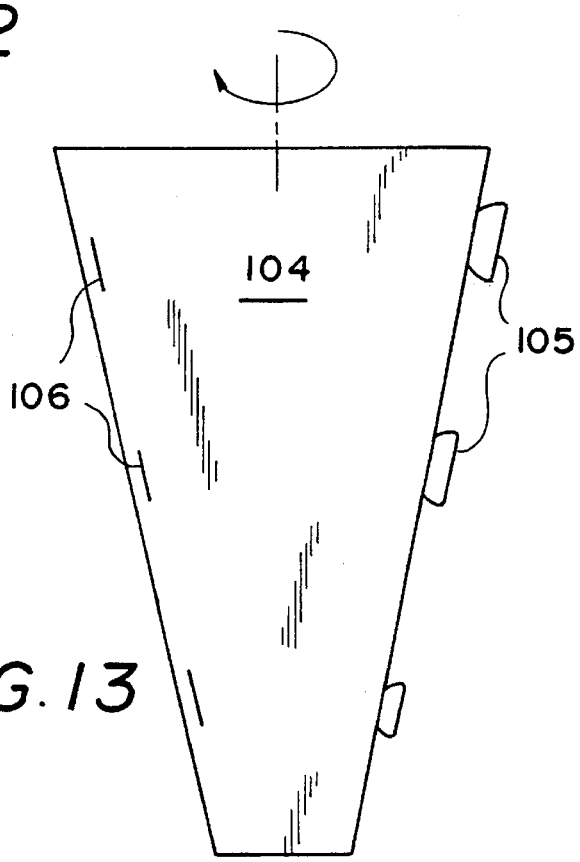
FIG. 13 is a side elevational view of a piece of flexible sheet material which is shaped such that the user may form a tapered wand.

An even simpler and lower-cost wand is illustrated in FIG. 12 wherein a slightly tapered, cone-shaped wand 100 is illustrated as containing at least one confetti bundle 102. Wand 100 may be made of rigid-type plastic such that it retains its shape when bundle 102 is wedged therein, but preferably, wand 100 is composed of deformable material such as those previously described with reference to FIGS. 5–6, or wand 100 may be made of rolled paper or lightweight cardboard so as to be deformable when bundle 102 is wedged therein in the same manner as previously described with reference to FIGS. 9–11. While deformable wand 100 would be pre-manufactured if composed of molded, deformable plastic, or rubber or plastic foam, the present invention contemplates the sale of a kit to the user including a pre-cut sheet 104 of flexible plastic, heavy paper or lightweight cardboard as shown in FIG. 13. The sheet may be rolled into one or several layers and taped or glued, or connector means such as tabs 105 and slots 106 may be provided along with instructions as to how to roll the sheet once and lock the tabs in the slots in order to form the tapered, slightly cone-shaped wand. While many grades of heavy paper, lightweight cardboard, or flexible plastic sheets are useable, one preferred material is the lightweight cardboard commonly used for file folders generally referred to as "manila folders." In this regard, it has been found that only one layer of such ultra-low-cost cardboard is sufficient to use many times and the disposal problem is completely eliminated.

With regard to the degree of taper in the FIG. 12 and 13 embodiments, as well as that of FIGS. 3–6, it has been found that the degree of taper, and hence the amount of frictional force imposed upon the bundle wedged in the tapered barrel portion of the wand, is of substantial importance. While the preferred degree of taper is a function of the rigidity, or degree of deformability of the barrel, and also of how tightly compacted the bundle is before insertion into the barrel, it has been found that a slight outward taper of 1 to 10 degrees from the vertical, as indicated by angle a in FIG. 12, results in a preferred amount of frictional contact so as to retain the bundle while achieving maximum heights of the bundle with minimum effort by the user. In addition, it has been found that an angle a of taper of only 1 to 5 degrees is optimum. Stated otherwise, the degree of taper and the degree of deformability should be sufficient to fictionally secure and retain the bundle in the barrel during the rapid forward motion of the forearm, but not sufficient to retain the bundle in the barrel when the wrist is flicked forwardly at the end of the forward arm motion which wrist motion generates the maximum amount of centrifugal force.

Figure 14:
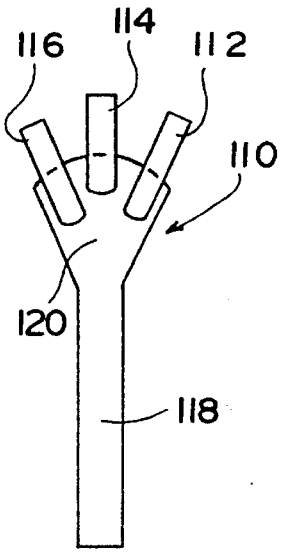
FIG. 14 is a side elevational view of an alternate form of wand wherein the parts may be a one-piece unit, or separate parts secured together permanently or removably.

It is also to be understood that the advantages of a reusable wand, along with the advantages of one or more short barrels of either rigid or deformable materials, may be achieved without the further advantages of removable or interchangeable barrels. That is, for example as shown in FIG. 14, the complete wand 110 may be manufactured as a one-piece, molded plastic unit or composed of plastic or rubber foam material with one or more barrels 112, 114 and 116 forming integral parts of the one-piece unit. Thus, the short barrels having preferred lengths in the order of one to three inches may be reloaded with one to three and preferably one or two bundles each, and with the relatively long handle 118, which is preferably in the order of six to twelve inches, the bundles may be shot 20 feet or more into the air with very little effort on the part of the user. Also, multiple bursts may be obtained at widely-spaced horizontal positions in the air if the multiple barrels are positioned at acute angles relative to each other as shown in FIG. 14 and as previously described with reference to FIG. 7. In addition, the eventual problem of disposal of the rubber or plastic may be substantially reduced or totally eliminated if one or more parts of the wand are made of cardboard and/or rolled paper. That is, for example, handle 118 may be made of cardboard as described with reference to FIG. 9 and only the barrel portion may be made of foam or solid plastic. Alternatively, the barrels may be made of cardboard or rolled paper and glued or otherwise secured to base portion 120 which itself may be composed of either plastic or cardboard and may be integral with, or attached to, the handle.

Figure 15:
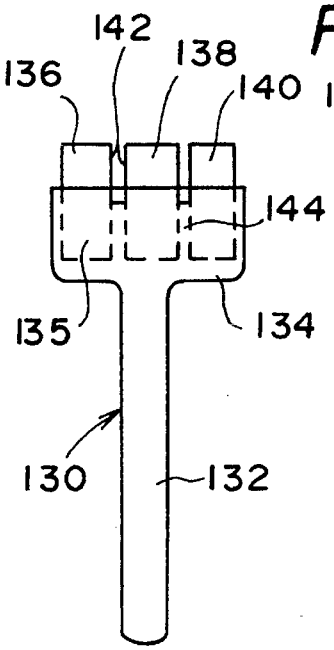
FIG. 15 is a side elevational view of a wand with a single barrel portion sized such as to receive multiple bundles of confetti in one enlarged barrel.

As further illustrated in FIG. 15, a wand 130 may have a handle portion 132 and an enlarged head portion 134; the latter being integral with or removably connected to the handle. In either event, the head is made sufficiently wide to provide a single cavity 135 large enough to contain multiple bundles, such as the three illustrated bundles 136, 138 and 140. In the illustrated embodiment, the vertical sides 142 of the bundles may be in direct contact with each other with no partitions therebetween. Alternatively, partitions 144 may be provided between the bundles and these may be angled to eject the bundles in non-parallel trajectories. It will be apparent that this embodiment may be easily molded as a single, one-piece wand of very low cost, or it may be composed of other biodegradable materials as previously described.

Figure 16:
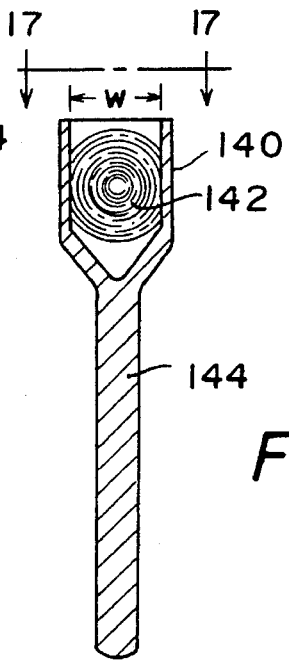
FIG. 16 is a side cross-sectional view of a wand having a barrel portion particularly designed to launch rolled streamers of confetti.
Figure 17:
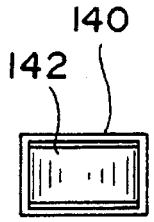
FIG. 17 is a top plan view looking downwardly on the barrel and streamer as indicated by view line 17—17 of FIG. 16.

With respect to preferred dimensions, the length L of the stack or bundle, as shown in FIGS. 1, 3 and for example, is preferably within the range of about 1.5 to 2.5 inches long with a length of 1.75 to 2.25 being most preferred for use in the present invention. The preferred width W of the stack or bundle has been found to be in the order of 0.5 to 1.25 inches, with 0.75 to 1.0 inches being more preferred, and the thickness T of the stack or bundle has been found to be in the order of 0.5 to 1.75 inches with 0.75 to 1.5 inches being optimum. For example, within these dimensions, very large, colorful displays may be obtained with only one bundle being launched at a time because the individual pieces are sufficiently large to create high visual impact. Also, the single bundle can be launched 20 or 30 or more feet into the air so as to result in a very long hang time as the tetragonal and/or truncated triangular pieces flutter, twirl and float slowly to the ground. Alternatively, the wand of the present invention may be particularly designed and sized as shown in FIG. 16 to launch rolled confetti, commonly called "streamers," including the streamers containing "bubbles" as described in U.S. Pat. No. 5,354,227 which is hereby incorporated by reference. As shown in FIG. 16, the barrel 140 is sized with a width w which is preferably slightly less than the diameter of the streamer roll 142 so that the streamer roll is slightly compressed or wedged in the barrel. The barrel may be made of any of the rigid or deformable materials previously described, and a handle 144 may be made integral with the barrel portion, or may be separable so as to be useable with the barrel portions of the above-described embodiments. Therefore, it is to be understood that the term "confetti" as used herein is intended to include rolls of confetti or streamers, and such streamers with or without additional confetti pieces rolled therein as described in the last-mentioned patent.

From the foregoing description, it will be apparent that individual features, preferred dimensions and specific materials illustrated with respect to one particular figure of drawing are intended to be applicable to and usable with various features, or dimensions or materials illustrated with respect to another figure of drawings. As such, the descriptions of several possible embodiments as illustrated in the drawings are intended to illustrate the principles and various features of the invention, rather than limit such combinations of features to the specifically illustrated configurations, and that the true legal invention is not intended to be limited other than as specifically set forth in the following claims as interpreted under the doctrine of equivalents.

What is claimed is:

1. A wand for launching confetti into the air, said wand comprising:

(a) a barrel portion having at least one cavity of a size and shape such as to receive and contain a stack of tetragonal shaped pieces of confetti, said cavity being closed at one end;

(b) at least one stack of tetragonal shaped confetti in said cavity, said at least one stack of confetti being wrapped by a wrapper to form a wrapped bundle of confetti;

(c) a handle portion connected to said barrel portion, said handle portion being of substantially longer length than said barrel portion whereby, upon grasping said handle portion and waving said barrel portion rapidly in an arcuate path, said wrapped bundle of tetragonal shaped confetti is forcefully ejected from said cavity high into the air.

2. A wand for launching confetti into the air comprising:

(a) a short barrel portion having at least one cavity therein, said cavity being of a size and shape to receive and frictionally retain a stack of pieces of confetti:

(b) a stack of tetragonal shaped pieces of confetti in said cavity, said stack of confetti pieces being wrapped by a wrapper to form a wrapped bundle of confetti;

(c) a long handle portion connected to said barrel portion, said handle portion being of substantially greater length than said barrel portion; and (d) connector means for removably connecting said barrel portion to said handle portion whereby said barrel portion may be readily removed from said handle and replaced by another barrel portion and said handle portion may be grasped to wave said barrel portion in an arc, whereby said wrapped bundle of confetti is forcefully projected high into the air.

3. A wand for projecting at least one stack of confetti high into the air comprising:

(a) an elongated, one-piece tapered cone having first and second ends;

(b) said cone having a tapered barrel portion adjacent said first end, said first end having a larger diameter than said second end;

(c) said cone having a tapered handle portion adjacent said second end, said second end having a diameter smaller than said first end;

(d) a stack of tetragonal shaped pieces of confetti, said stack being wrapped to form a wrapped bundle;

(e) said barrel portion being of a sufficient cross-sectional size to receive said bundle of confetti pieces with at least a portion of said bundle frictionally wedged into said tapered barrel portion whereby, upon grasping said handle portion and waving said barrel portion in an arcuate path, centrifugal force builds and overcomes said frictional wedging such that said bundle of tetragonal shaped pieces of confetti is forcefully projected high into the air where said bundle bursts into hundreds of pieces of tetragonal shaped confetti which flutter and float slowly downwardly.

* * * * *